United States Patent [19]

Pazmany

[11] 4,296,895

[45] Oct. 27, 1981

[54] FIN ERECTION MECHANISM

[75] Inventor: Ladislao Pazmany, San Diego, Calif.

[73] Assignee: General Dynamics Corporation, San Diego, Calif.

[21] Appl. No.: 3,358

[22] Filed: Jan. 15, 1979

[51] Int. Cl.[3] ..... F12B 15/16

[52] U.S. Cl. ..... 244/3.29; 102/388

[58] Field of Search ..... 102/4; 244/3.27, 3.28, 244/3.29

[56] References Cited

U.S. PATENT DOCUMENTS

| | | | |
|---|---|---|---|
| 3,004,489 | 10/1961 | Griffith et al. | 244/3.27 X |
| 3,114,318 | 12/1963 | Barnes, Jr. et al. | 244/3.28 X |
| 3,125,956 | 3/1964 | Kongelbeck | 244/3.29 |
| 3,711,040 | 1/1973 | Carver | 244/3.29 X |
| 3,853,288 | 10/1974 | Bode | 244/3.29 |

*Primary Examiner*—Peter A. Nelson

*Attorney, Agent, or Firm*—John R. Duncan; Frank D. Gilliam

[57] ABSTRACT

A plurality of fins for a missile which are capable of being folded to conform to the general cylindrical contour of the missile body and which are biased to unfold to an erect position and which includes an interconnection mechanism for connecting all the fins together to ensure simultaneous erection and for distributing the erection moment of individual fins to all fins; said interconnection means further being capable of acting without interfering with the movement of the fins for flight control without need for disengagement after erection.

7 Claims, 9 Drawing Figures

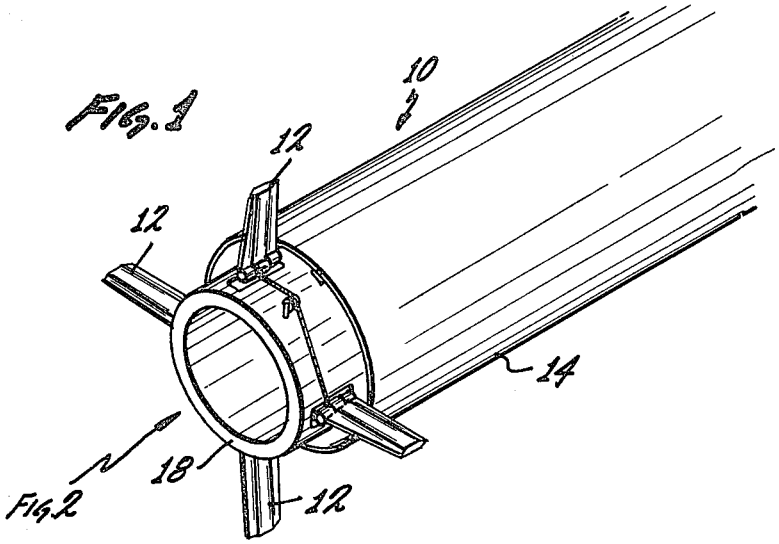
FIG. 1
10
12
12
14
18
12
FIG. 2
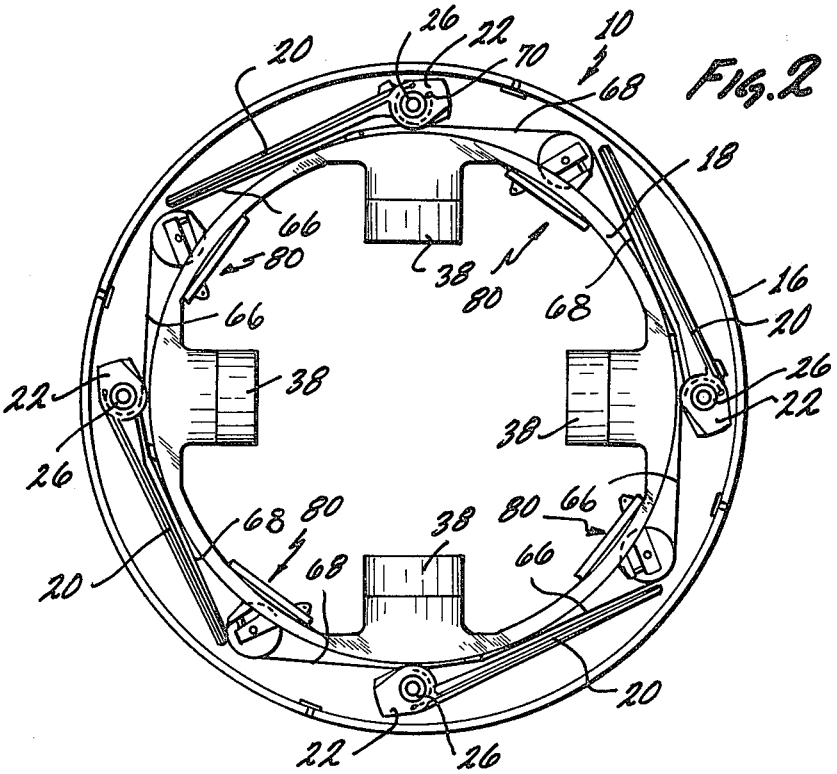
FIG. 2
10
20
26
22
70
68
18
66
80
38
80
68
16
20
66
22
38
26
26
22
38
68
80
38
80
66
20
68
66
20
22
26

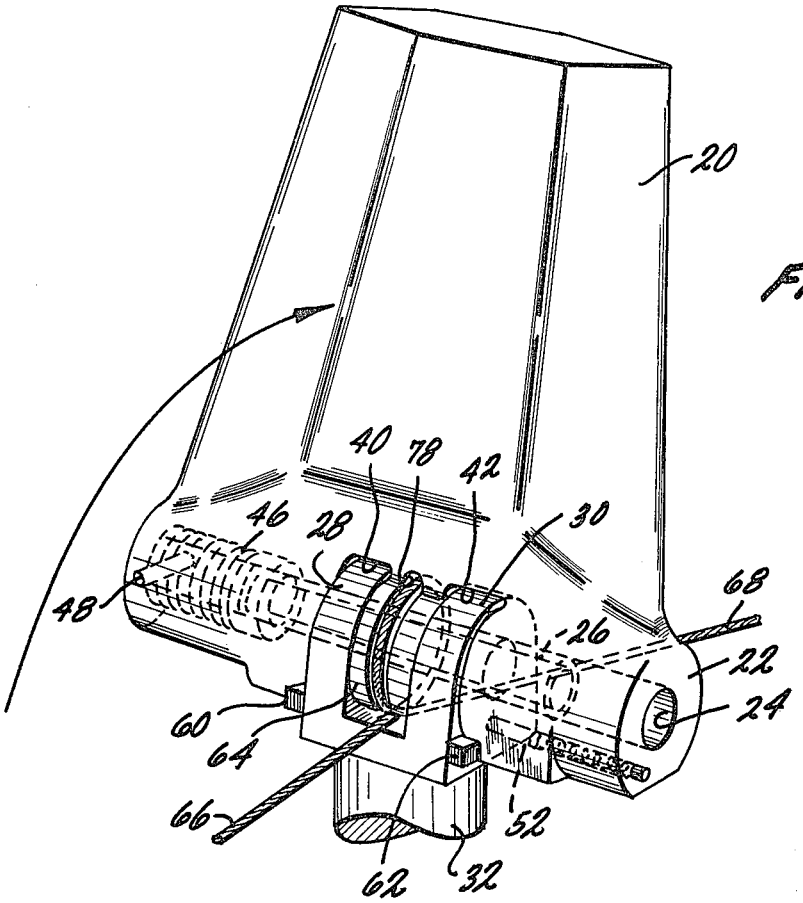
FIG. 5
FIG. 6
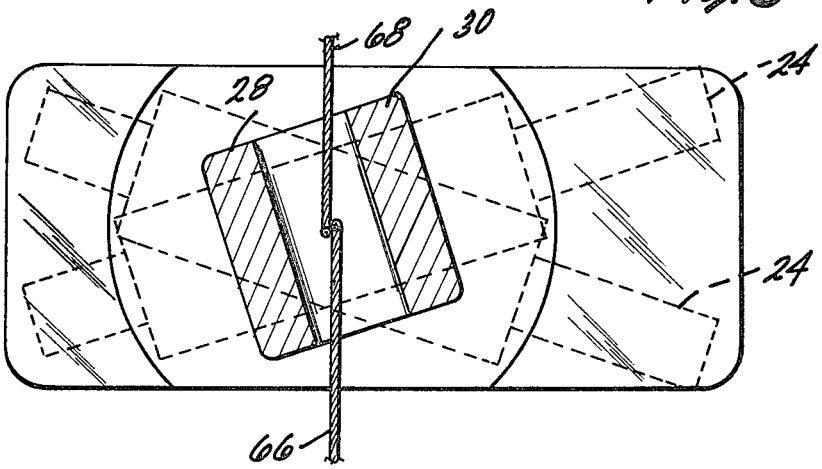

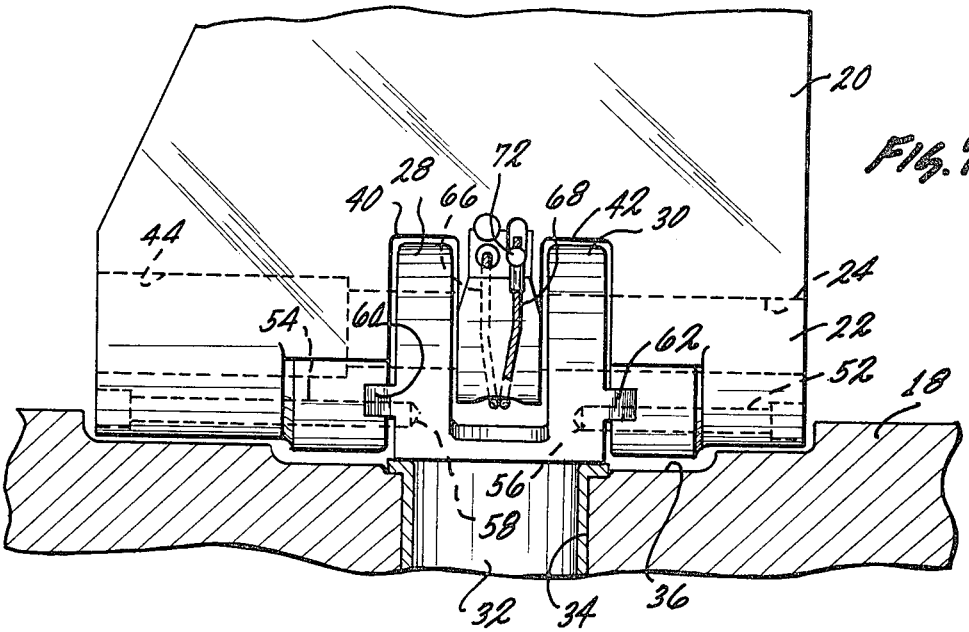
FIG. 7
FIG. 8
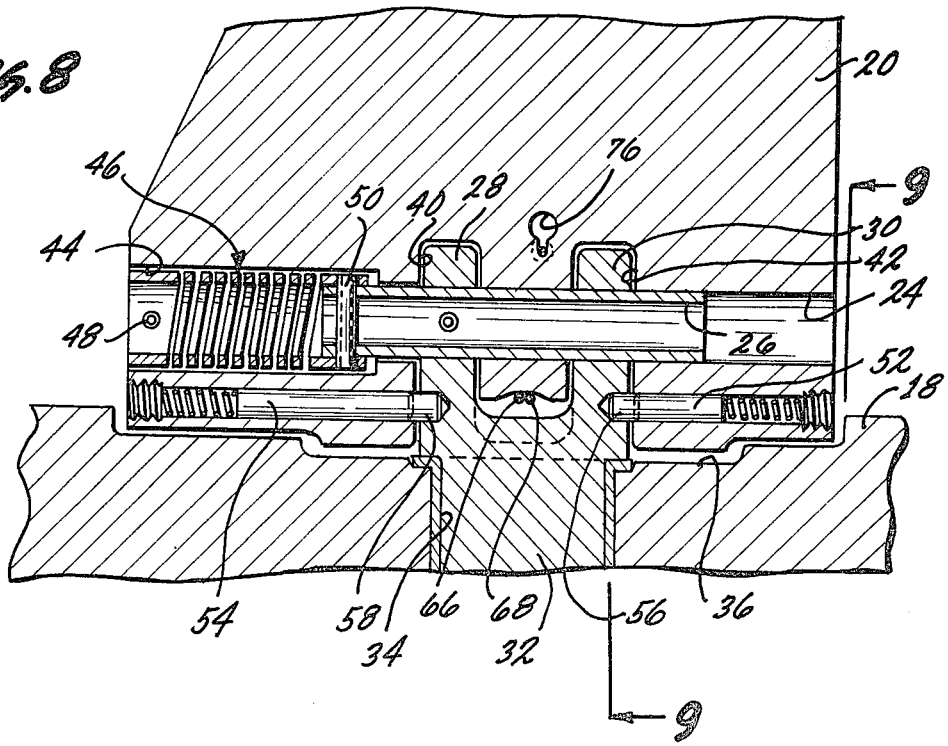

FIN ERECTION MECHANISM

BACKGROUND OF THE INVENTION

This invention relates to foldable fins for missiles and, in particular, to new and improved foldable fin erection mechanism therefor.

The use of fins, which are folded during launching, and which are deployed for the stabilization and control of a missile during flight are well known; see for example, the U.S. Pat. No. 3,853,288 to Bode, No. 3,125,956 to Kongelbeck, No. 3,697,019 to Watson and many others.

However, none of the prior art dealt directly with the problem of overcoming the large erection moments of opposite sign of individual fins, of ensuring simultaneous erection of the fins to avoid missile control problems, etc.

Accordingly, it is a primary object of this invention to provide a fin erection mechanism for missiles which assures simultaneous erection and which reduces the total erection moment.

SUMMARY OF THE INVENTION

The invention which meets the foregoing object comprises a plurality of fins on a missile which are capable of being folded to conform to the general cylindrical contour of the missile body and which are biased to unfold to an erect position and which includes an interconnection means for connecting all the fins together to ensure simultaneous erection and for distributing the erection moment of individual fins to all fins; said interconnection means further being capable of acting without interfering with the movement of the fins for flight control without need for disengagement after erection.

Accordingly it is another object of this invention to provide an interconnection means for connecting all the fins of a missile together which is capable of acting without interfering with the rotational control means of the fins once the fins are erected.

Still another object of this invention is to provide an interconnection means which distributes the erection moment of individual fins to all the fins.

Other object and advantages of the invention will be apparent to one skilled in the art after a study of the drawings and the description of the invention herein.

BRIEF DESCRIPTION OF THE DRAWINGS

FIG. 1 is a perspective illustration of the aft end of a missile showing the fins in an erected position and a partial showing of the means for interconnecting the fins together;

FIG. 2 is an enlarged end view of the missile and fins looking in the direction of the arrow identified as FIG. 2 in FIG. 1.

FIG. 5 is a perspective illustration of one of the fins in erected position with the details of the construction of the base portion of the fin in phantom;

FIG. 6 is a schematized plan view to illustrate the capability of the fin flight control mechanism to move the fins without interference from the interconnecting means;

FIGS. 7 and 8 illustrate the details of the fin and the steering control shaft and the means for locking the fins in erected position.

BRIEF DESCRIPTION OF THE PREFERRED EMBODIMENT

Figure 3:
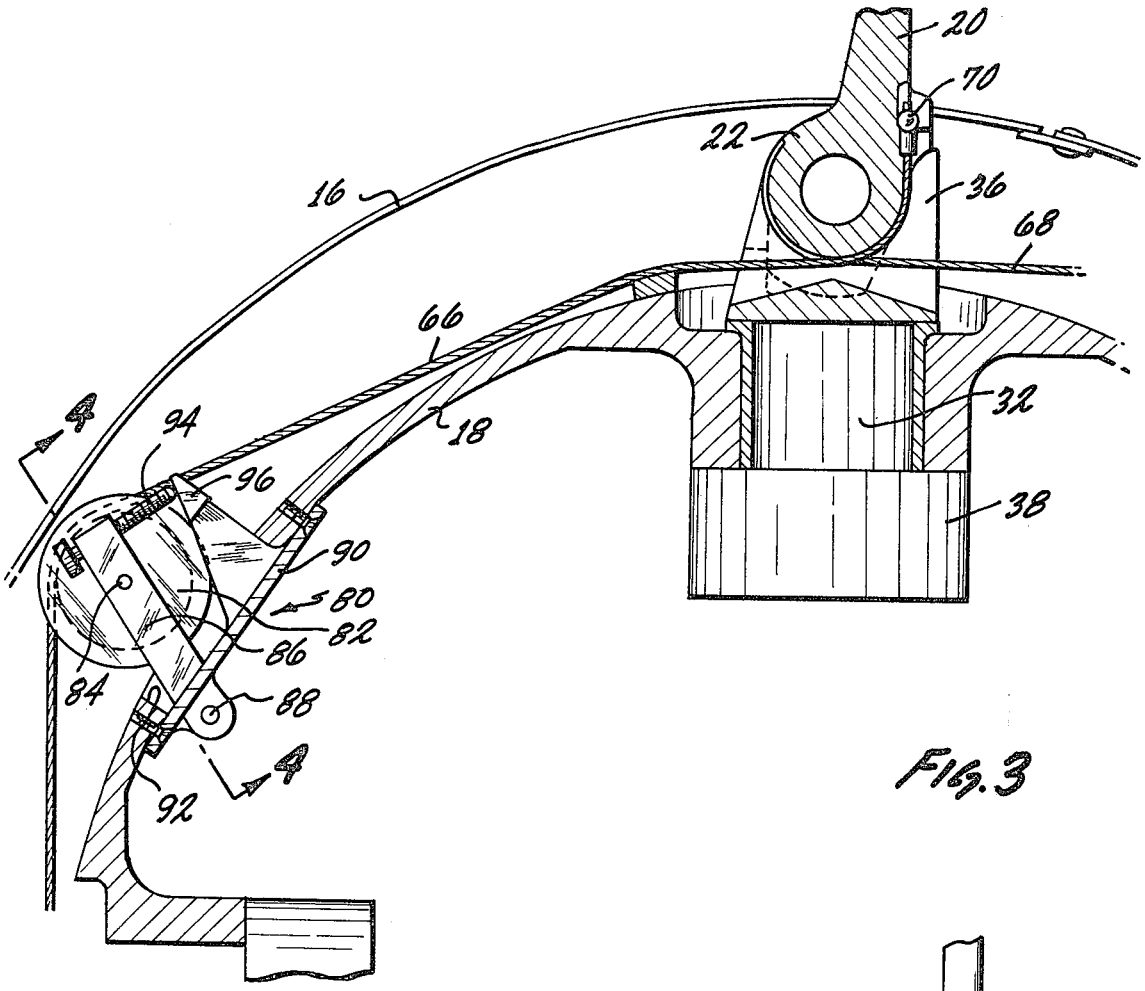
FIG. 3 is a partial end view, enlarged over FIG. 2 and partly in section, to show the details of the erection of interconnection means and the fin flight control actuators.
Figure 4:
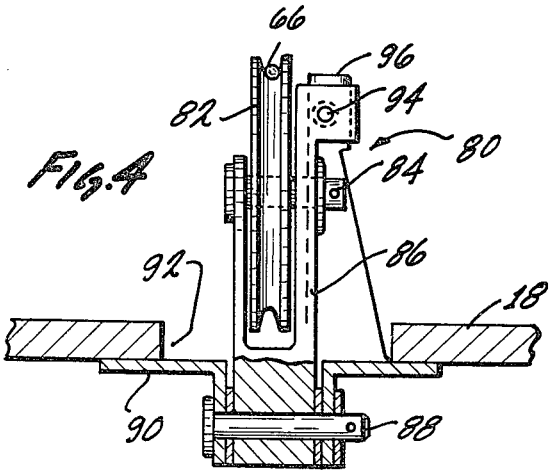
FIG. 4 is a view taken along line 4—4 of FIG. 3.
Figure 9:
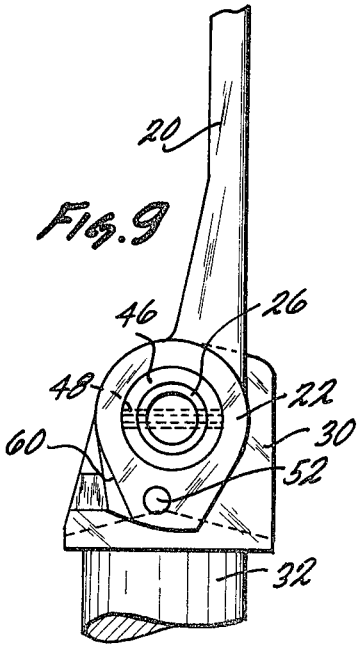
FIG. 9 is a partial end view of the fin to illustrate the stop mechanism to prevent the fin from overtraveling its erected position.

The terms "missile", "launching", and "flight" as used herein are to be interpreted in their broadest sense and are thus to include any body (projectile), air or water borne, projected, either by an external or internal force (launched or dropped), which body can continue on by its own inertia, or is self-propelled or is free-falling.

Refering now to the drawings, the aft end of a missile 10 is shown in perspective in FIG. 1 with four foldable fins 12 attached thereto. The fins are constructed to fold in a counter-clockwise direction as viewed in FIG. 2 within the cylindrical contour of an outer skin 16 yet outwardly of a main body frame 18. For launching purposes, the fins are folded within the outer cylindrical contour of the skin 16 and, during flight, are rotated clockwise to an erected position such as that shown in FIG. 1.

Each fin 12 includes a main steering portion 20 with a thicker integral base portion 22 placed longitudinally of the missile. The base portion is provided with a longitudinal bore in which a shaft 26 is inserted to rotatably secure the fin to a bifurcated end, in the form of two apertured lugs 28 and 30, formed on a control shaft 32 disposed for rotation radially of the missile. The radial control shaft 32 extends through a suitable opening 34 in the body 18, which opening is enlarged near the lugs, as at 36, to allow limited movement of the base portion and lugs. The control shaft 32 is governed by a suitable control means, shown schematically as a servo motor 38, connected to the shaft to control the fins for stabilization and steering of the missile.

The base portion 22 is suitably formed with a pair of slots 40 and 42 complimentary to lugs 28 and 30 to receive the lugs and is also formed with a longitudinal counter bore 44 to receive a torsion spring 46 fixed at one end to the base portion 22 by a pin 48 and at the other end to the shaft 26 by a second pin 50 to provide the bias for erection of the fin. The base portion 22 is also provided with two spring loaded locking pins 52 and 54 longitudinally oriented which engage suitable bores 56 and 58 in the lugs 28 and 30 to lock the fin in a erected position. Of course, the pins are held out of the bores 56 and 58 by the side walls of the lugs when the fin is in its folded position. Also, in addition to the locking pins 52, 54, the lugs 28, 30 are also provided with projections 60 and 62 extending longitudinally to the missile to engage the base portion 22 when the fin is in an erected position as shown in FIG. 5 to provide a stop means to prevent overtravel of the fins.

The central lug of the base portion 22 formed by the slots 40 and 42 is formed in the shape of a center fin pulley 64 for two cables 66 and 68 which are partially wrapped around the pulley in opposite directions. These cables 66, 68 have swagged ball terminals 70 and 72 to connect the cables to the pulley 64 by insertion in suitable keyhole slots 76 not shown in the base portion 22. Suitable clearance for the cables as at 78, in the base portion 22 is provided to allow freedom of movement of the cables within the base portion when the fin is in folded position. Finally, each fin is interconnected to the adjacent two fins and thus each fin is interconnected.

To tension the cables 66 and 68, a pretensioning device 80 is located between each fin. The pretensioning device comprises an idler roller 82 engaging one of the cables and rotatably connected on a center shaft 84 located on a idler lever 86 which in turn is pivotedly connected at 88 to a base 90. The idler lever 86 is connected to the missile body 18 and extends through a suitable opening 92 and is provided with a screw 94 which engages a stop means 96 to adjustably position the idler lever relative to the body 18 and cable 66 to provide a means of tensioning the cable.

As best seen in FIGS. 5 and 6, the cables 66 and 68 partially wrap around the fin center pulley 64. Actually, the two cables 66 and 68 cross over the axis of rotation of the fin for control and stabilization of the missile and therefore the fin can be rotated within a moderate angle, approximately plus or minus 20° without significant restraint by the cables. Thus, the cables need not be removed for flight control movement of the fins.

In operation, the fins 12 are folded against their respective torsion springs 46 to provide the spring bias for erection and, at the appropriate time the fins are erected by the action of the torsion spring until stopped by the stop means 60, 62 and locked into position by the two locking pins 52, 54. The movement of the fins toward the erected position causes the cables 66 and 68 on each fin to react with the other fins so that the erection of all the fins occurs simultaneously. Also while the erection moments of individual fins are quite high and of opposite sign, all of the fins being interconnected for simultaneous erection, causes a reduction in the total erection moment and, once the fins are erected, the interconnection means (cables) permit the rotation of the fins by the flight control actuator 38. Note at each individual cable, such as 66 or 68, terminates at adjacent fins so that the ends are on the axis of the control shaft 32, and as an interconnection means, they need not be disconnected during flight.

I claim:

1. Fin erection mechanism for a missile having a longitudinally cylindrical body frame and a plurality of foldable fins for flight control comprising, means longitudinally of said missile for connecting said fins to said missile, means for bracing said fins toward an erect position, means for interconnecting said fins together so that erection of all of said fins occurs simultaneously, said means for interconnecting comprises cable means for connecting one fin to fins located on each side of said one fin so that erection of said one fin influences the erection of said finds located on each side of one fin, each fin of said fins is formed with a pulley means and wherein said cable means is attached and guided by said pulley means during the erection of said fins, and control means disposed radially of said main axis of said missile for rotating said fins while erected for flight control and wherein said pulley means is located on the axis of rotation of said control means so that said cable means do not interfere with limited rotation of said fins.

2. The invention as defined in claim 1 wherein said first means longitudinally of said missile for folding said fins comprises first shaft means within a base portion of said fin and wherein said control means comprises second shaft means with lug means thereon for engaging said first shaft means.

3. The invention as defined in claim 2 wherein said pulley means encompasses said first shaft means between said lug means for spacing said cable means from said shaft means and lug means and orienting said cable means axially of said second shaft means.

4. The invention as defined in claim 3 wherein said lug means has stop means thereon for engaging said fins for preventing overtravel of said fins during the erection movement.

5. The invention as defined in claim 4 further including means for locking said fins and lug means together in fin erected position.

6. The invention as defined in claim 5 wherein said cable means comprises individual cables whose ends terminate at adjacent fins, and means for tensioning said individual cables.

7. The invention as defined in claim 6 wherein said biasing means comprises a torsion spring encompassing said first shaft means.

* * * * *